US009605923B2

(12) United States Patent
McPherson

(10) Patent No.: US 9,605,923 B2
(45) Date of Patent: Mar. 28, 2017

(54) ARCHERY BOW LIMB BEDDING

(71) Applicant: MCP IP, LLC, Sparta, WI (US)

(72) Inventor: Mathew A. McPherson, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 378 days.

(21) Appl. No.: 13/665,667

(22) Filed: Oct. 31, 2012

(65) Prior Publication Data

US 2013/0192573 A1 Aug. 1, 2013

Related U.S. Application Data

(60) Provisional application No. 61/591,235, filed on Jan. 26, 2012.

(51) Int. Cl.

| | |
|---|---|
| ***F41B 5/14*** | (2006.01) |
| ***F41B 5/10*** | (2006.01) |
| *F41B 5/00* | (2006.01) |

(52) U.S. Cl.

CPC ..... *F41B 5/14* (2013.01); *F41B 5/10* (2013.01); *F41B 5/1403* (2013.01); *F41B 5/0026* (2013.01)

(58) Field of Classification Search

CPC ..... F41B 5/14; F41B 5/10; F41B 5/0026

USPC ..... 124/23.1, 25.6, 86, 88; 403/292, 296, 403/300, 345; 29/428

See application file for complete search history.

(56) References Cited

U.S. PATENT DOCUMENTS

| | | | | | |
|---|---|---|---|---|---|
| 1,396,788 | A | * | 11/1921 | Shepherdson | F41B 5/0026 124/24.1 |
| 2,717,465 | A | | 9/1955 | Clark, Jr. et al. | |
| 3,107,450 | A | | 10/1963 | Snyder et al. | |
| 3,156,230 | A | * | 11/1964 | Groves | F41B 5/0026 124/23.1 |
| 3,628,519 | A | | 12/1971 | Hofmeister | |
| 3,921,598 | A | | 11/1975 | Helmick | |
| 4,571,871 | A | | 2/1986 | Timari | |
| 4,579,621 | A | | 4/1986 | Hine | |
| 5,247,758 | A | | 9/1993 | Mason | |
| 5,280,779 | A | * | 1/1994 | Smith | F41B 5/0026 124/23.1 |
| 5,291,874 | A | * | 3/1994 | Harrison | F41B 5/0026 124/23.1 |
| 5,339,790 | A | * | 8/1994 | Smith | F41B 5/10 124/23.1 |
| 5,377,658 | A | * | 1/1995 | Shepley, Jr. | F41B 5/10 124/23.1 |
| 5,429,106 | A | * | 7/1995 | Martin | F41B 5/0026 124/23.1 |
| 5,433,792 | A | * | 7/1995 | Darlington | F41B 5/10 124/23.1 |
| 5,464,001 | A | * | 11/1995 | Peck | F41B 5/10 124/23.1 |
| 5,487,373 | A | * | 1/1996 | Smith | F41B 5/10 124/23.1 |
| 5,507,270 | A | * | 4/1996 | Smith | F41B 5/0026 124/23.1 |
| 5,592,929 | A | * | 1/1997 | Hoyt, Jr. | F41B 5/1438 124/23.1 |

(Continued)

*Primary Examiner* — Alexander Niconovich

(57) ABSTRACT

A bow limb retaining assembly including a retainer comprising at least one limb pocket, at least one bow limb configured and arranged to engage the at least one limb pocket and at least one adhesive composition disposed between at least a portion of the at least one limb pocket and the at least one bow limb.

20 Claims, 9 Drawing Sheets

(56) References Cited

U.S. PATENT DOCUMENTS 5,720,267 A * 2/1998 Walk ..... F41B 5/10 124/23.1
5,816,233 A * 10/1998 Andrews ..... B29C 63/42 124/23.1
6,024,076 A * 2/2000 Laborde ..... F41B 5/0026 124/23.1
6,276,351 B1 * 8/2001 Treadway ..... F41B 5/0026 124/23.1
6,360,734 B1 * 3/2002 Andrews ..... F41B 5/10 124/23.1
6,367,464 B1 * 4/2002 Bronnert ..... F41B 5/0094 124/23.1
6,371,098 B1 * 4/2002 Winther ..... F02D 41/1456 123/691
6,543,432 B2 * 4/2003 Andrews et al. ..... 124/23.1
6,571,785 B1 * 6/2003 Choma ..... F41B 5/123 124/23.1
6,869,285 B1 3/2005 Jones, II
6,886,549 B2 * 5/2005 McPherson ..... F41B 5/0026 124/23.1
7,258,113 B2 * 8/2007 Pilpel ..... F41B 5/10 124/23.1
7,293,936 B1 * 11/2007 Warren ..... F16B 37/085 124/23.1
7,334,575 B2 * 2/2008 McPherson ..... F41B 5/0026 124/23.1
8,365,712 B2 * 2/2013 Jolley et al. ..... 124/89
8,425,820 B2 * 4/2013 Pilpel ..... 264/162
2002/0078939 A1 * 6/2002 Andrews ..... F41B 5/10 124/10
2005/0229912 A1 * 10/2005 Pilpel ..... F41B 5/10 124/86
2008/0127961 A1 6/2008 McPherson
2009/0050125 A1 * 2/2009 Davis ..... F41B 5/0026 124/23.1
2009/0145411 A1 * 6/2009 Sims ..... F41B 5/10 124/25.6
2009/0241928 A1 * 10/2009 Blosser ..... F41B 5/10 124/25.6
2009/0277067 A1 11/2009 Gregg
2011/0303203 A1 * 12/2011 Jolley ..... F41B 5/1426 124/23.1
2013/0118463 A1 * 5/2013 Trpkovski ..... F41B 5/0094 124/25.6
2013/0269672 A1 10/2013 McPherson

* cited by examiner

ARCHERY BOW LIMB BEDDING

CROSS-REFERENCE TO RELATED APPLICATIONS

This application claims the benefit of U.S. Provisional Patent Application No. 61/591,235, filed Jan. 26, 2012, the entire content of which is hereby incorporated herein by reference.

BACKGROUND OF THE INVENTION

This invention relates to an archery bow and more specifically a system for retaining archery bow limbs.

All US patents and applications and all other published documents mentioned anywhere in this application are incorporated by reference in their entirety.

Prior art archery bows are known to have bow limbs anchored to a bow handle/riser. In many cases, these archery bows use a limb pocket to attach the bow limbs to the bow handle. In order to retain a limb in the limb pocket, some known limb pockets sandwich a portion of the bow limb between a floor of the limb pocket and an opposing ceiling. Alternatively, some known limb pockets sandwich a limb between the floor of the limb pocket and the head of a threaded bolt.

When limb pockets are employed, slight shifting of the limb in the limb pocket can occur resulting in less accuracy when shooting. Also, even if a bow exhibits no limb shift during use while the limbs are fully secured in place, any degree of freedom in the fitment between a limb pocket and a limb can lead to changes if the bow is serviced (e.g. disassembled and reassembled). If the limbs are not reassembled in the exact configuration as before, the bow may shoot slightly differently after reassembly.

Commonly assigned U.S. Pat. No. 6,886,549 discloses and claims a mounting system for adjustably mounting a bow limb to a bow riser, wherein the bow limb is laterally restrained relative to the bow riser in an efficient yet solid manner. An adjustable bow mounting system pivotally compensates the strut assembly at various attachment angles and provides greater structural stability under the typically high bowstring tensions.

There remains a need in the art to provide for a limb mount that allows little if no shifting of the limb in the cup. There remains a need for a bow having limbs that can be removed and reassembled in a configuration as similar as possible to the original configuration.

These and other aspects, embodiments and advantages of the present disclosure will become immediately apparent to those of ordinary skill in the art upon review of the Detailed Description and Claims to follow.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

In one embodiment, the present invention relates to a bow limb retaining assembly for an archery bow, the retaining assembly including a retainer comprising at least one limb pocket, at least one bow limb configured and arranged to engage the at least one limb pocket and at least one adhesive composition disposed between at least a portion of the at least one limb pocket and the at least one bow limb.

In another embodiment, the present invention relates to a bow limb retaining assembly including a retainer comprising at least one limb pocket, the limb pocket comprising a bottom surface, an end wall portion, a first lateral side wall and a second lateral side wall opposing the first lateral side wall, a bow limb configured and arranged to engage the bottom surface, the end wall portion, the first lateral side wall and the second lateral side wall of the at least one limb pocket and at least one adhesive composition disposed between at least a portion of the bottom surface, the end wall portion, the first lateral side wall and/or the second lateral side wall of the limb pocket and the bow limb, or combinations thereof.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
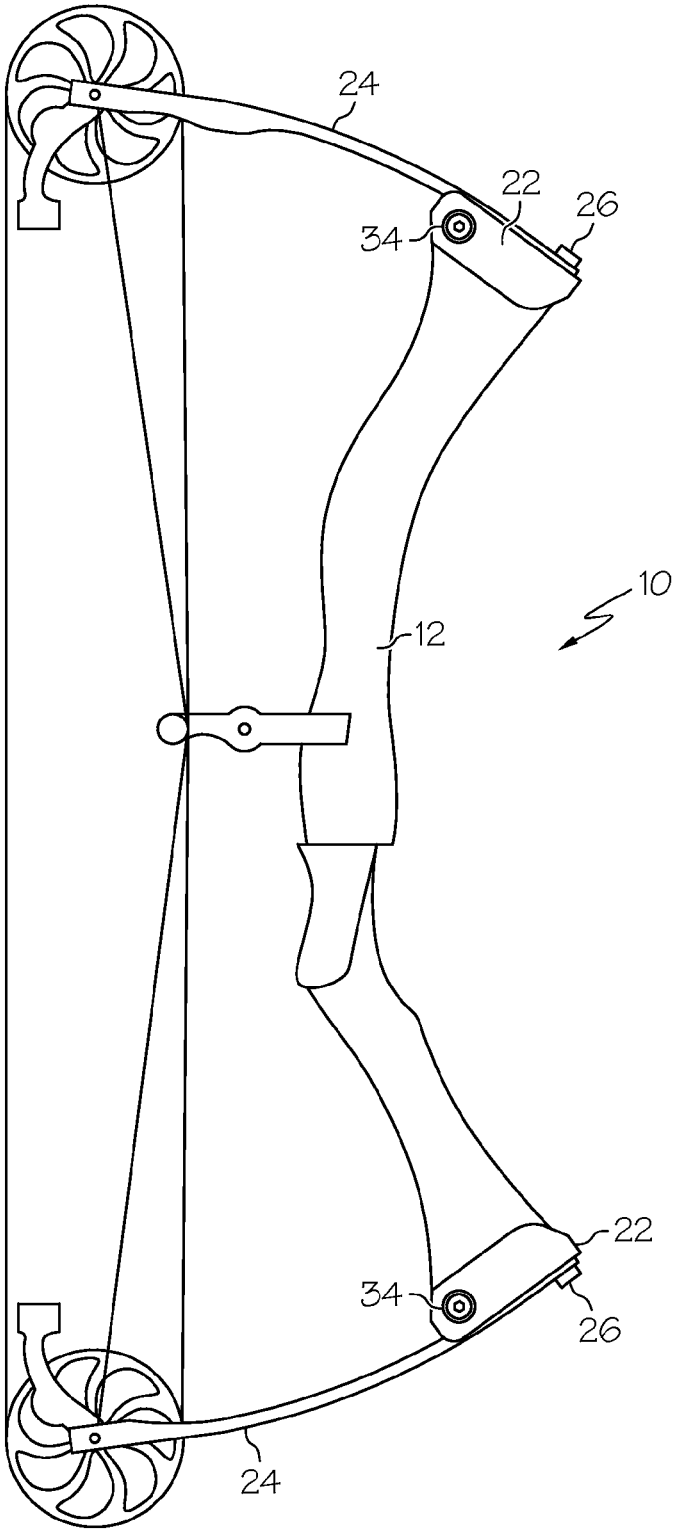
FIG. 1 is an embodiment of an archery bow having a limb retaining system according to the invention.

While embodiments of the present disclosure may take many forms, there are described in detail herein specific embodiments of the present disclosure. This description is an exemplification of the principles of the present disclosure and is not intended to limit the disclosure to the particular embodiments illustrated.

For the purposes of this disclosure, like reference numerals in the figures shall refer to like features unless otherwise indicated.

The present invention relates to a limb retaining assembly wherein the outside profile of the end of a bow limb for an archery bow is configured and arranged, such as by machining techniques, to closely fit the profile of a limb pocket in which it is fitted. An adhesive composition is disposed between at least a portion of the bow limb and limb pocket to further restrict any lateral or pivoting of the end of the limb in any direction other than the intended plane of bending. This achieves a custom fitment between the limb and limb pocket. In some embodiments, there is a location fit or a slight interference fit.

The present invention is not restricted by the type of archery bow or limb retaining assembly employed. The specific embodiments of a limb retaining system are employed herein for illustrative purposes only and do not limit the scope of the present invention. Examples of suitable archery bows and limb retaining systems are disclosed in commonly assigned U.S. Pat. Nos. 6,886,549 and 7,334,575, and U.S. Provisional Patent Application No. 61/256,844, each of which is incorporated by reference herein in its entirety.

Turning now to the figures, FIG. 1 illustrates an embodiment of an archery bow 10 having a limb retaining system 20 including a limb pocket 22 having a bow limb 24 disposed therein and secured to handle 12 of bow 10 with limb bolt 26. The limb retaining system comprises an adhesive (shown in FIG. 2 below) according to the invention.

Figure 2:
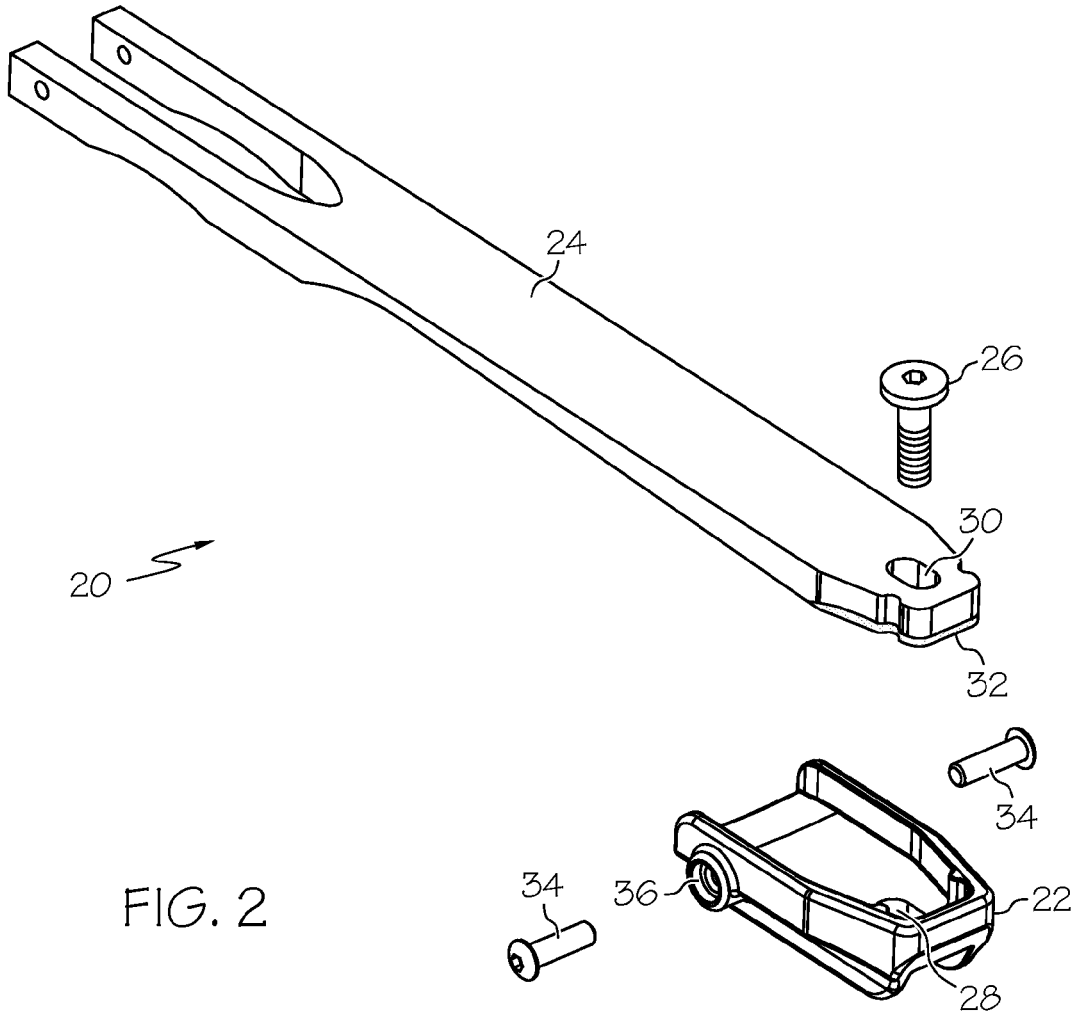
FIG. 2 is an exploded view illustrating one embodiment of a limb retaining system showing the limb pocket and bow limb.

FIG. 2 is an exploded view of limb retaining system 20 illustrating limb pocket 22 and bow limb 24. Limb pocket 22 has a limb bolt opening 28 and bow limb 24 has a corresponding limb bolt opening 30 wherein limb bolt 26 may be inserted into openings 28, securing the limb retaining system 20 to bow handle 12 as shown in FIG. 1.

In this embodiment, an adhesive 32 is shown disposed on the bottom portion of the end of the bow limb 24 which is configured and arranged to be snuggly received in limb pocket 22. Limb pocket 22 further includes openings 36 for receiving bolts 34 which can threadingly engage the bow handle 12 as shown in FIG. 1. Placement of the adhesive 32 is not limited to that which is shown in FIG. 2. Adhesive 32 can be used in any suitable location to improve securement between the limb pocket 22 and limb 24. For example, the adhesive 32 can be placed on half of the end portion or even the entirety of the end portion of the bow limb 24. Moreover, the adhesive 32 need not be placed on the bow limb 24 but rather can be disposed on the end portion of the limb pocket 22 as well or can be disposed on both the bow limb 24 and the limb pocket 22.

Figure 3:
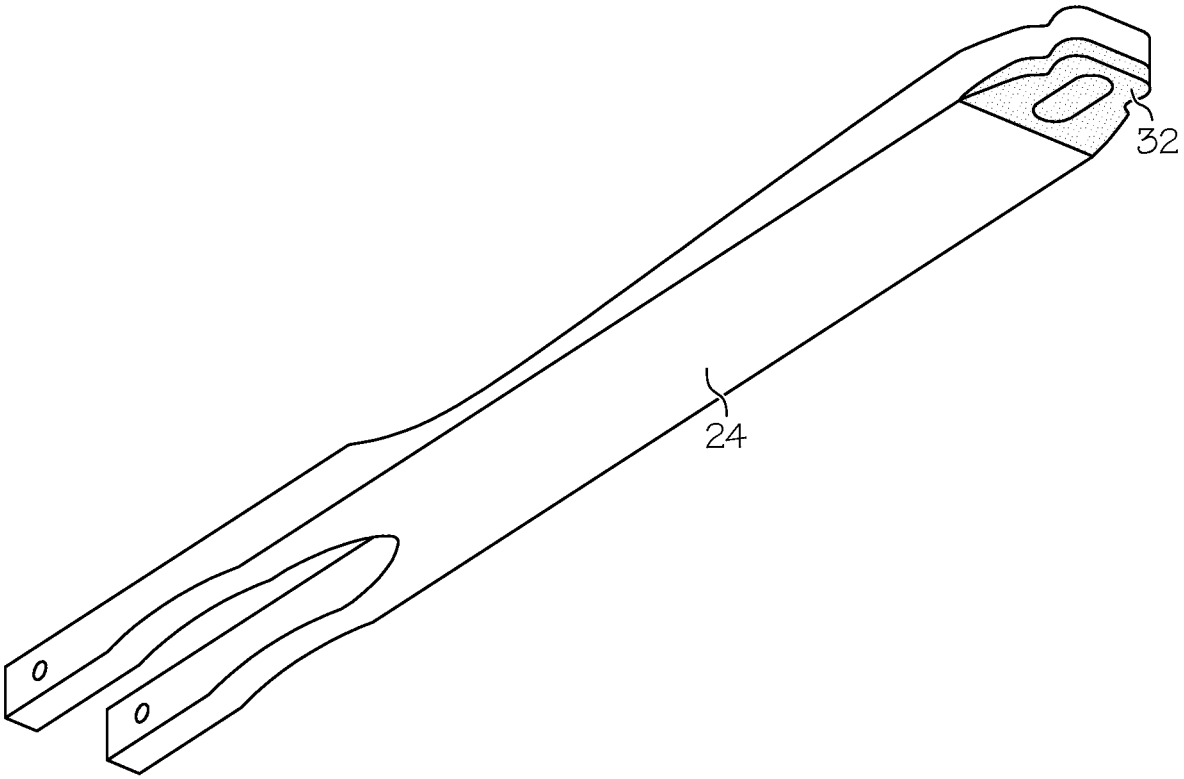
FIG. 3 shows an alternative perspective view of the bottom of a limb similar to that in FIG. 2.

FIG. 3 is a perspective view of the bottom of bow limb 24 as shown in FIG. 2. Adhesive 32 is shown disposed on a portion of the end portion of bow limb 24 to facilitate a more snug engagement with limb pocket 22.

Figure 4:
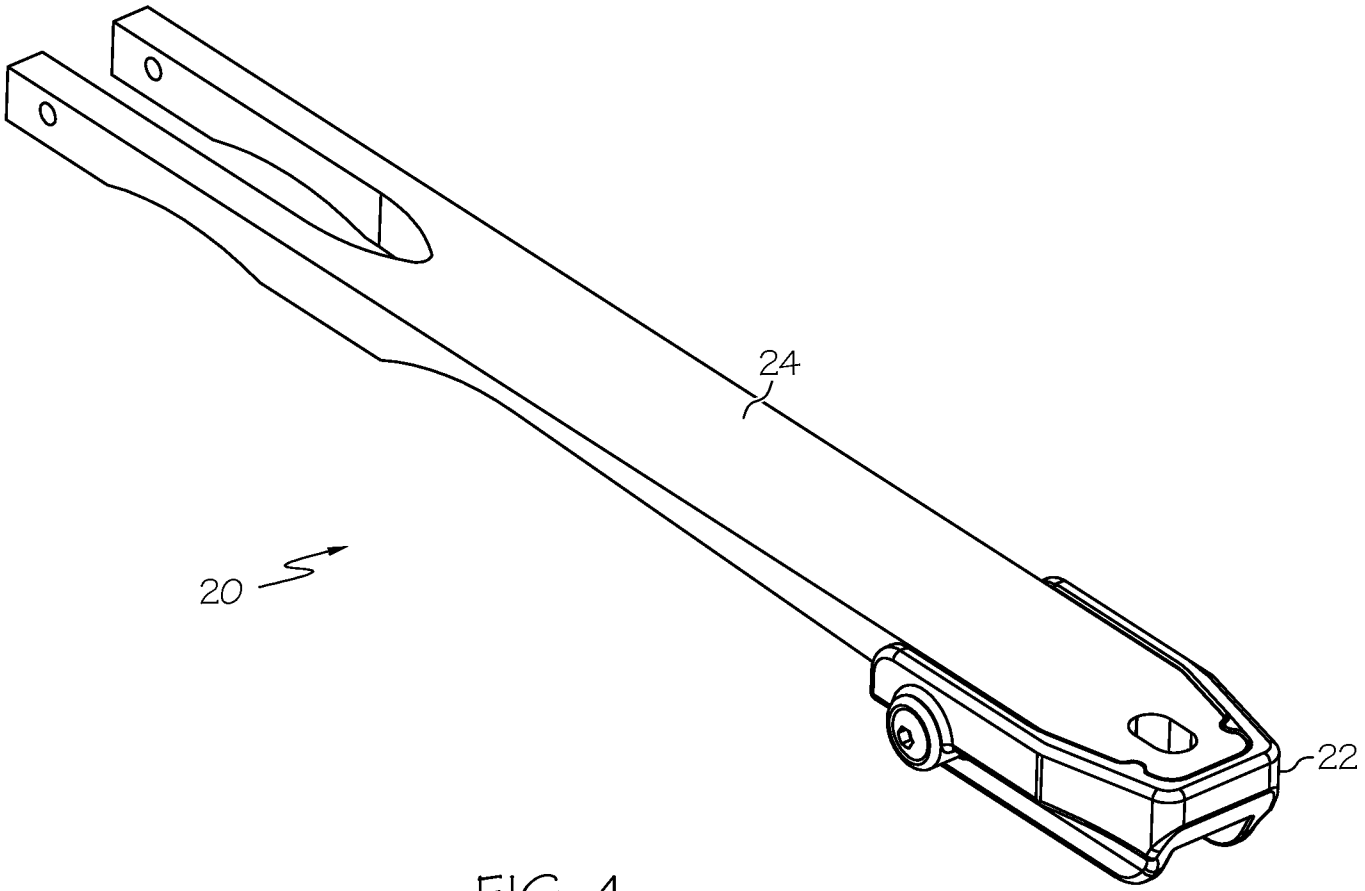
FIG. 4 is a perspective view of a limb retaining assembly illustrating a bow limb snuggly engaged within a limb pocket.

FIG. 4 is a perspective view of limb retaining assembly 20 as shown in FIGS. 2 and 3 with bow limb 24 snuggly engaged within limb pocket 22. The adhesive 32 (not visible in FIG. 4) contacts the limb pocket 22 and the bow limb 24.

Figure 5:
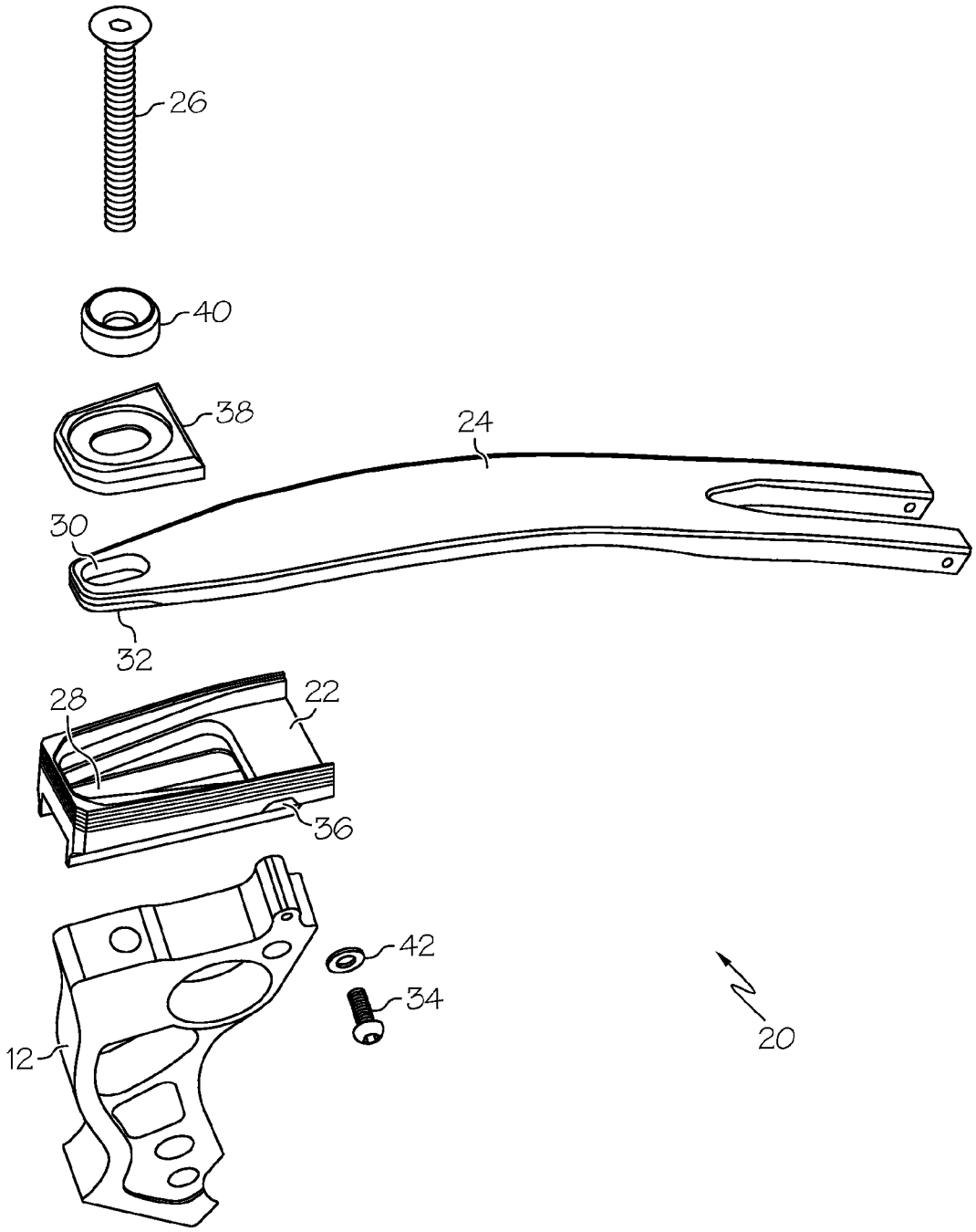
FIG. 5 is an exploded view of an alternative limb retaining assembly employing an adhesive composition according to the invention.

FIG. 5 is an exploded perspective view of an alternative limb retaining assembly 20 illustrating limb pocket 22 having a limb bolt opening 28 and bow limb 24 having a corresponding limb bolt opening 30 for receiving limb bolt 26 which along with compression washer 40 secures the limb retaining assembly to the handle 12 of bow 20 (as shown in FIG. 1). In this embodiment, a limb cap 38 is shown between the compression washer 40 and bow limb 24 to minimize vibration and noise.

Bolt 34 is also shown with a compression washer 42 and may be received in threaded opening 36 of limb pocket 22 for engaging the limb retaining assembly 20 to the handle 12 of bow 10 (as shown in FIG. 1).

Adhesive 32 is shown disposed on the end of bow limb 24 to facilitate a more snug fit in limb pocket 22.

Figure 6:
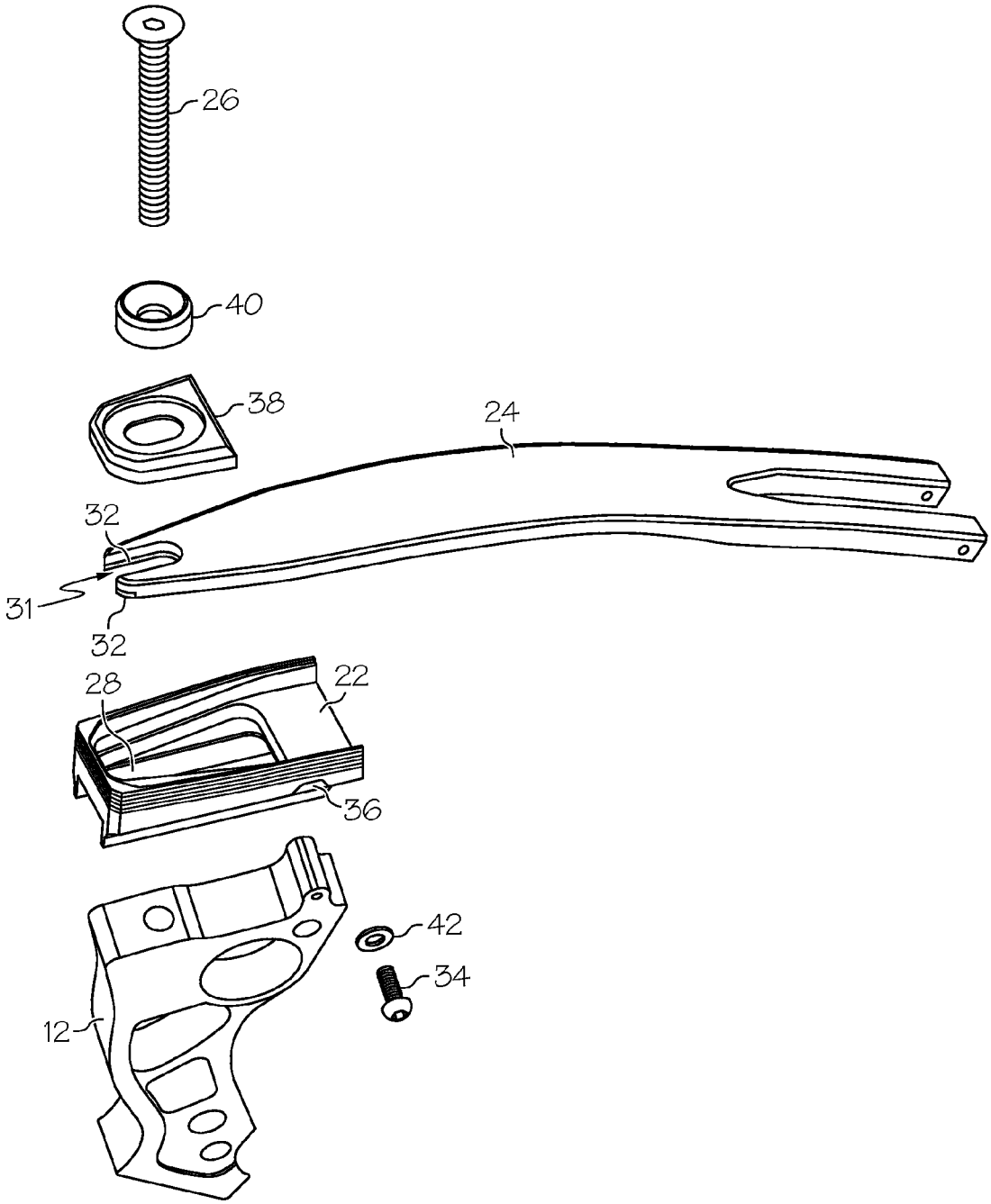
FIG. 6 is an exploded view of yet another alternative limb retaining assembly employing an adhesive composition according to the invention.

An alternative embodiment of a limb retaining assembly 20 is shown in exploded perspective view in FIG. 6. This embodiments has features similar to those shown in FIG. 5 which the exception that bow limb 24 is shown having a forked end 31 which may further comprise adhesive 32.

Figure 7:
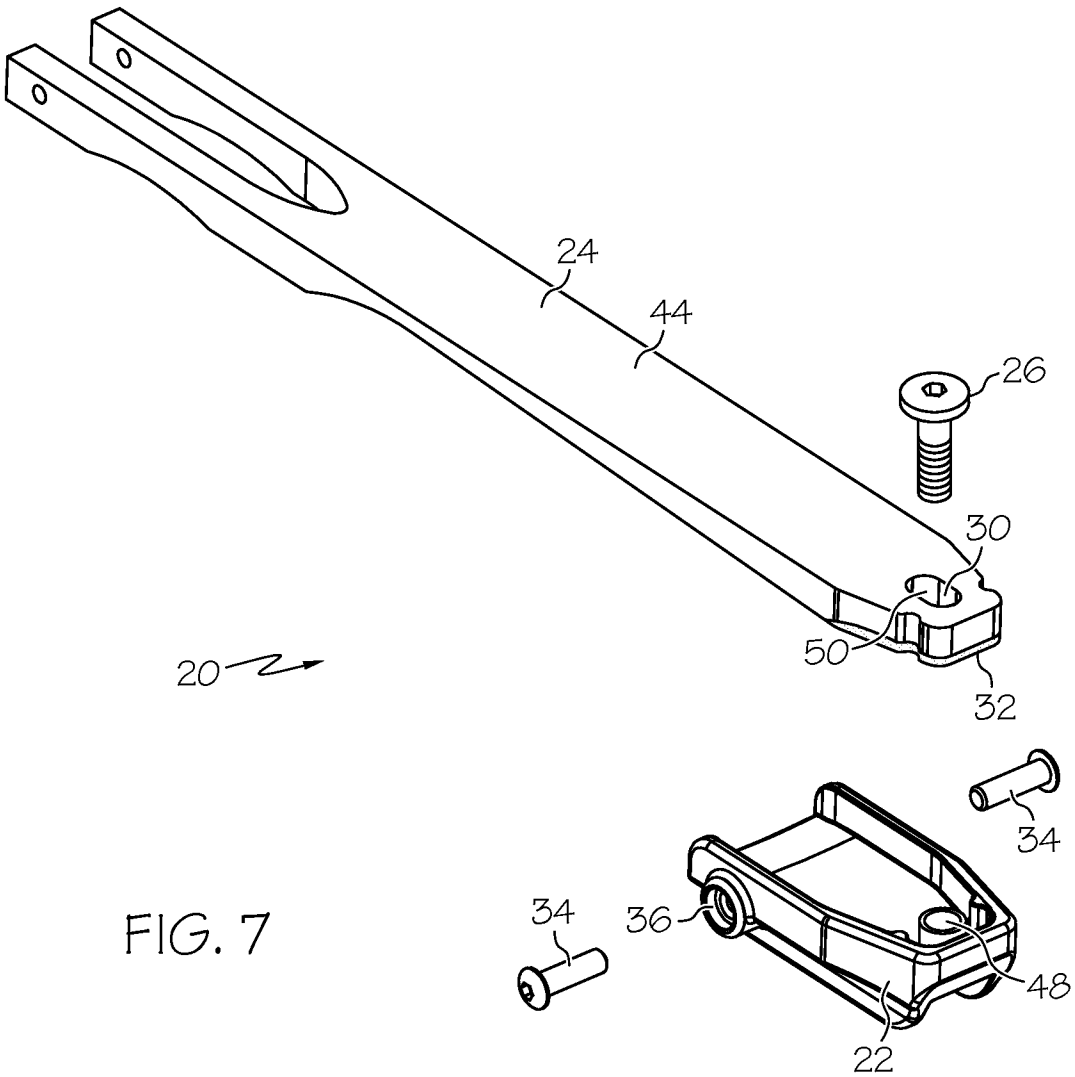
FIG. 7 is an exploded view of an alternative embodiment of a limb retaining assembly employing an adhesive composition according to the invention.

FIG. 7 illustrates an embodiment of a limb retaining assembly 20 similar to that shown in FIG. 2. However, in this embodiment, rather than a simple limb bolt opening in limb pocket 22 as shown in FIG. 2, there is a flanged limb bolt opening 48. The opening 30 in bow limb 24 is disposed and slides over the flange 48 providing further securement of the bow limb 24 to the limb pocket 22.

Figure 8:
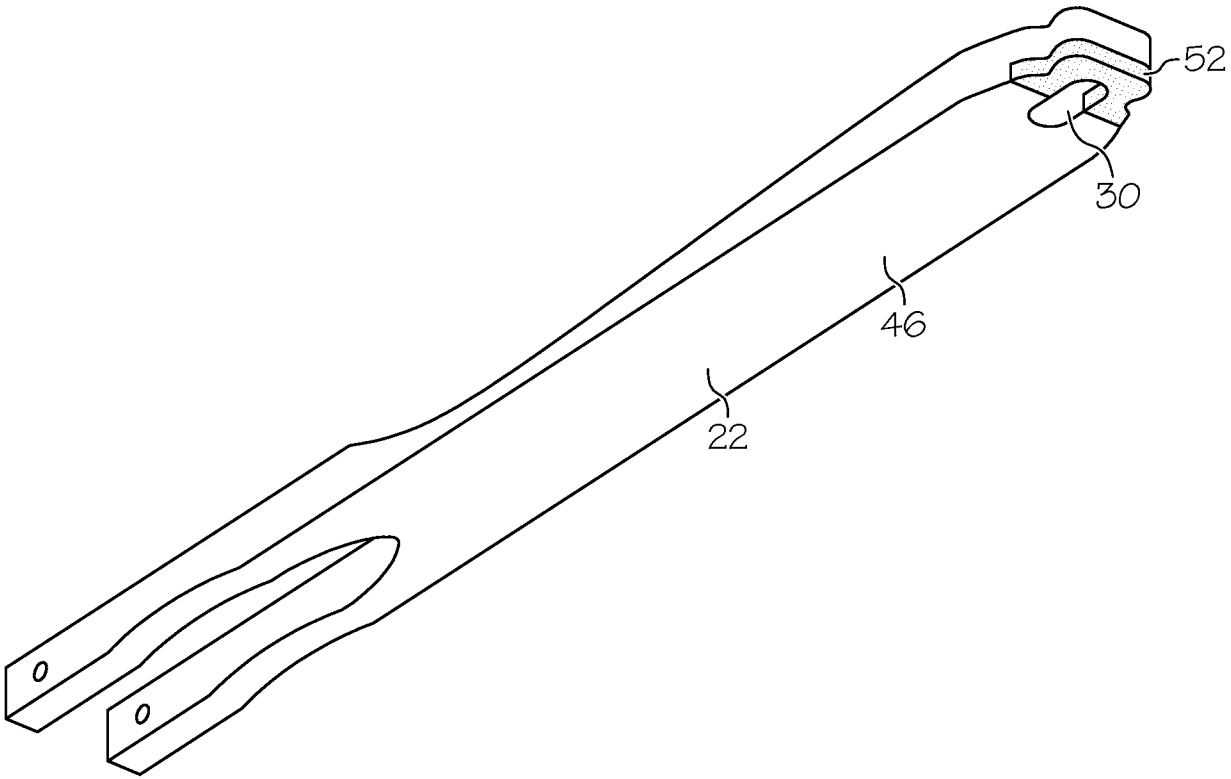
FIG. 8 is a perspective bottom view of the bow limb of the limb retaining assembly of FIG. 7.

Moreover, in this embodiment, adhesive 32 is disposed on at least a portion of the wall 50 of the opening 30 defined by the outer surface 44 (shown in FIG. 7) and inner surface 46 (shown in FIG. 8) of the bow limb 24. The adhesive 32 is shown disposed on the wall 50 of the opening 30 in FIG. 8 as well as on a portion of the bottom of the end portion of bow limb 24. The adhesive 32 will therefore be disposed between the opening 30 of the bow limb 24 and the flange 48 of limb pocket 22 as well as between portions of the bow limb 24 and limb pocket 22.

As previously discussed, adhesive 32 can be applied elsewhere on the bow limb 24 or can be alternatively applied to flange 48 or the limb pocket 22.

Figure 9:
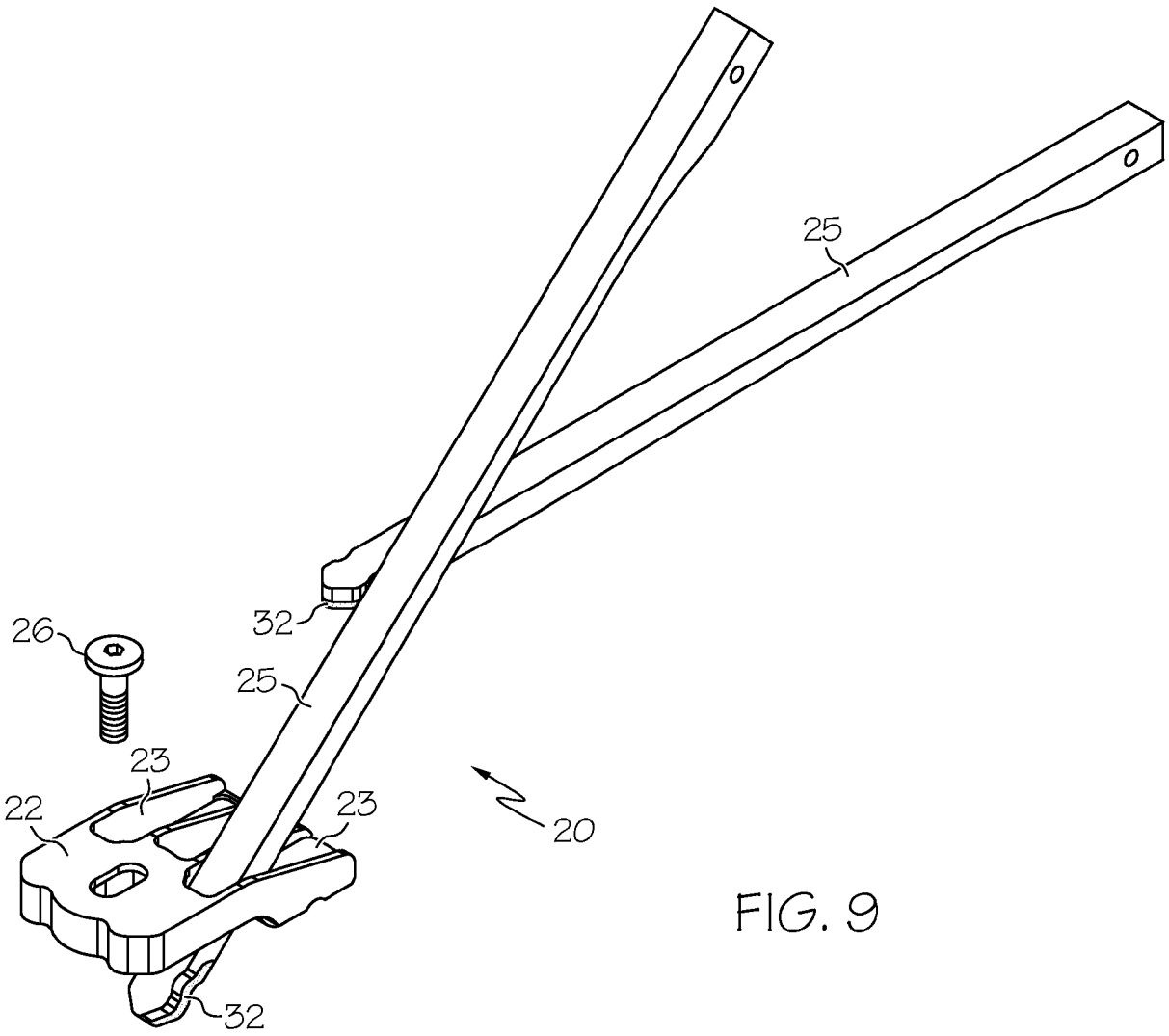
FIG. 9 is a perspective view of an alternative embodiment of a limb retaining assembly having split limbs.

FIG. 9 is a perspective view illustrating an alternative embodiment of a limb retaining assembly 20 having split limbs 25 which are retained in separate slots 23 in limb pocket 22. An adhesive composition 32 is shown disposed on the end of each of the split limbs 25. The adhesive composition may also be disposed on the bottom of each of the split limbs 25 and the pattern of the application may be changed on the end portion of the split limbs 25 as well. Alternatively, the adhesive composition 32 may be applied to the end portion of each slot 23 of the limb pocket 22.

Desirably, the adhesive 32 is provided to bed the limb 24/25 to the limb pocket 22. As such, in some embodiments, the adhesive 32 can be considered part of a limb 24/25 assembly, better conforming the shape of the limb assembly to the shape of the limb pocket 22. In some embodiments, the adhesive 32 can be considered part of a limb pocket 22 assembly, better conforming the shape of the limb pocket assembly to the shape of the limb 24/25.

In some embodiments, a limb pocket 22 can be considered a part of the riser 12. In some embodiments, a riser 12 can be provided with a receiving cavity similar the limb receiving cavities disclosed with respect to limb pockets 22 herein, and a limb 24 can be bedded to the riser 12 using the adhesive 12.

Any suitable adhesive composition may be employed herein including thermoplastic, thermoset, and water based adhesives.

Suitably, the adhesive composition is a thermoset adhesive composition. Thermoset adhesive compositions are available in both one-part and two-part form and cure via a variety of different mechanisms including radiation curable, heat curable and moisture curable adhesives. Two-part or multipart adhesives typically cure upon chemical reaction of the components upon mixing.

Radiation curable thermoset adhesive compositions include those which crosslink upon exposure to ultraviolet (UV) radiation. UV thermoset adhesive compositions are typically acrylic based adhesives. Examples of specific UV curable compounds useful herein include, but are not limited to, epoxy (meth)acrylates, urethane (meth)acrylates, polyester (meth)acrylates, acrylic (meth)acrylates, and so forth.

Examples of suitable moisture curing compositions include, but are not limited to, polyurethanes and polyorganosiloxanes. These are typically one-part systems which crosslink via the addition of moisture.

Examples of suitable one-part systems which cure via the addition of heat or heat and pressure include, but are not limited to epoxies, polyurethanes, and polyimides.

Examples of suitable two-component curing systems which cure via chemical reaction between two or more components, include, but are not limited to, epoxies, polyurethanes and acrylics. Two-component systems are beneficial because they typically do not require the addition of heat, radiation or moisture. The crosslinking reaction proceeds simply by mixing of the components.

However, the above mentioned two-component systems can be formulated to perform essentially as a one-component system by encapsulating one of the components, typically the initiator. The components can react upon application of pressure or pressure and heat.

These examples are intended for illustrative purposes only, and not as a limitation on the scope of the present invention.

In some embodiments, an epoxy adhesive composition or a polyurethane adhesive composition is employed.

Examples of suitable thermoplastic adhesive compositions include those based on thermoplastic elastomers which include, but are not limited to, Examples of thermoplastic elastomers suitable for use herein include, but are not limited to, natural and synthetic rubbers and rubbery block copolymers, such as butyl rubber, neoprene, ethylene-propylene copolymers (EPM), ethylene-propylene-diene polymers (EPDM), polyisobutylene, polybutadiene, polyisoprene, styrene-butadiene (SBR), styrene-butadiene-styrene (SBS), styrene-ethylene-butylene-styrene (SEBS), styrene-isoprene-styrene (SIS), styrene-isoprene (SI), styrene-ethylene/propylene (SEP), polyester elastomers, polyurethane elastomers, to mention only a few, and so forth and mixtures thereof. Where appropriate, included within the scope of this invention are any copolymers of the above described materials.

Examples of suitable thermoplastic adhesive compositions include those based on non-elastomeric polymer materials including, but not limited to, polyolefins including polyethylene, polypropylene, polybutylene and copolymers and terpolymers thereof such as ethylene vinyl acetate copolymers (EVA), ethylene n-butyl acrylates (EnBA), ethylene methyl (meth)acrylates including ethylene methyl acrylates (EMA), ethylene ethyl (meth) acrylates including ethylene ethyl acrylates (EEA), interpolymers of ethylene with at least one $C_3$ to $C_{20}$ alphaolefin, polyamides, polyesters, polyurethanes, to mention only a few, and so forth, and mixtures thereof. Where appropriate, copolymers of the above described materials also find utility herein.

Examples of suitable water-based adhesive compositions include, but are not limited to, polyurethane dispersions, acrylics, polyvinyl acetates, vinyl acetate copolymer emulsions such as vinyl acetate ethylene and vinyl acetate acrylate and polychloroprene.

Other optional components may be added to the adhesive composition including, but not limited to, tackifying resins, antioxidants, plasticizers, waxes, and so forth. Such components are well known to those of ordinary skill in the art.

In some embodiments, a filler is added to an epoxy or urethane adhesive composition. One example of a filler is a glass micro sphere filler or a chopped glass fiber. These fillers can be employed in amounts of about 5% to about 50% by volume and suitably about 15% to about 35% by volume of the epoxy composition.

One example is a 5 minute epoxy loaded with about 15% to about 35% by volume glass micro spheres. The 5 minute epoxies are well known and are commercially available from a variety of sources such as ITW Devcon, part of ITW Performance Polymers which is an international business unit of Illinois Tool Works (ITW) in Danvers, Mass., Permatex® PermaPoxy™ available from Permatex in Hartford, Conn., and Loctite® Brand-Consumer Products, Henkel Corporation in Westlake, Ohio.

The 5 minute epoxy adhesive composition are generally two-part epoxies which include an epoxy resin composition and an encapsulated initiator. Once mixed, the epoxy rapidly cures and crosslinks.

Bow limb grade epoxies may be employed as well. Bow limb grade epoxies are known to those of ordinary skill in the art.

Filled epoxy adhesive compositions are commercially available from JB Weld Company in Sulphur Springs, Tex., for example.

The description provided herein is not to be limited in scope by the specific embodiments described which are intended as single illustrations of individual aspects of certain embodiments. The methods, compositions and devices described herein can comprise any feature described herein either alone or in combination with any other feature (s) described herein. Indeed, various modifications, in addition to those shown and described herein, will become apparent to those skilled in the art from the foregoing description and accompanying drawings using no more than routine experimentation. Such modifications and equivalents are intended to fall within the scope of the appended claims.

All publications, patents and patent applications mentioned in this specification are herein incorporated by reference in their entirety into the specification to the same extent as if each individual publication, patent or patent application was specifically and individually indicated to be incorporated herein by reference. Citation or discussion of a reference herein shall not be construed as an admission that such is prior art.

An archery bow limb cup can be "bedded" to provide a more rigid interaction between the limb and limb cup. The bedding can improve tolerances between the limb and limb cup. The bedding can allow for a limb and limb cup that can be disassembled and the reassembled in the same configuration (e.g. closer to the exact same configuration as prior to disassembly than would be achieved in a traditional limb/cup).

In some embodiments, the limb can be adhesively secured to the limb cup.

It would be advantageous to provide a mounting system for adjustably mounting a bow limb to a bow riser, wherein the bow limb is laterally restrained relative to the bow riser in an efficient yet solid manner. Furthermore, an adjustable bow mounting system which pivotally compensates the strut assembly at various attachment angles would provide greater structural stability under the typically high bowstring tensions. It is also notable that due to the variations in bowstring tension which result from adjustment of the attachment angle, it would be further advantageous to provide a mounting system which measures and indicates relative bowstring tension at the various attachment angles.

The invention is also directed to methods bedded limbs as disclosed herein. In some embodiments, a limb 24 is provided, a limb pocket 22 is provided and an adhesive 32 is provided. The adhesive is applied to any suitable portion of the limb 24 and/or the limb pocket 22. The limb 24 is disposed in fitment with the limb pocket 22, for example as shown in FIG. 4. The adhesive 32 is allowed to cure. In some embodiments, additional steps are taken to achieve or speed curing, such as exposing the adhesive 32 to heat or UV light as appropriate.

In some embodiments, a method further comprises detaching the limb 24 from the limb pocket 22, wherein adhesive 32 can remain attached to the limb 24 and/or the limb pocket 24. The limb 22 can again be disposed in fitment with the limb pocket 24, wherein the existing adhesive encourages the limb 24 and limb pocket 24 to assume their original orientation with respect to one another.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A bow limb retaining assembly comprising:

a retainer comprising a side wall, said retainer defining at least one limb pocket, the side wall comprising an engaging feature comprising a protrusion or recess;

at least one bow limb configured and arranged to engage the at least one limb pocket, the bow limb comprising a complimentary engaging feature comprising a recess or protrusion, the complimentary engaging feature of the bow limb arranged to engage the engaging feature of the side wall;

a fastener arranged to attach the bow limb to the limb pocket; and a cured limb bedding material disposed between at least a portion of the at least one limb pocket and the at least one bow limb, said limb bedding material contacting said limb pocket and said bow limb.

2. The bow limb retaining assembly of claim 1 wherein the limb bedding material is a thermoset material.

3. The bow limb retaining assembly of claim 2 wherein the limb bedding material comprises at least one member selected from the group consisting of acrylics, polyurethanes, polyorganosiloxanes, epoxies and polyimides.

4. The bow limb retaining assembly of claim 2 wherein the limb bedding material is an epoxy or a polyurethane.

5. The bow limb retaining assembly of claim 4 wherein the limb bedding material is a one-part epoxy.

6. The bow limb retaining assembly of claim 4 wherein the limb bedding material is a two-part epoxy or two-part polyurethane.

7. The bow limb retaining assembly of claim 1 wherein the limb bedding material comprises a filler.

8. The bow limb retaining assembly of claim 1 comprising a split limb pocket and a split bow limb.

9. The bow limb retaining assembly of claim 1, wherein the at least one limb pocket comprises a bottom surface, an end wall portion, said side wall and a second side wall;

the bow limb configured and arranged to engage the bottom surface, the end wall portion, the first lateral side wall and the second lateral side wall of the at least one limb pocket; and the limb bedding material disposed between the bow limb and at least one of the bottom surface, the end wall portion, the side wall or the second side wall of the limb pocket.

10. The bow limb retaining assembly of claim 9 wherein the limb bedding material is disposed on at least a portion of the bow limb configured to engage the end wall of the limb pocket and a portion of the bottom surface of the bow limb configured and arranged to engage the bottom surface of the limb pocket that is adjacent the end wall of the limb pocket.

11. The bow limb retaining assembly of claim 1 the bow limb comprising an inner surface and an outer surface, and further comprising a first opening for receiving the fastener, the opening comprising a wall defined by the inner and outer surface of the bow limb, the limb pocket further comprising a second opening for receiving the fastener corresponding to the opening in the bow limb, the limb pocket further comprising a raised flange, the raised flange configured to engage the wall of the first opening in the bow limb.

12. The bow limb retaining assembly of claim 11 wherein the limb bedding material is between at least a portion of the wall of the first opening of the bow limb and the flange of the limb pocket.

13. The bow limb retaining assembly of claim 1 wherein the limb bedding material is applied to at least a portion of an end portion of the bow limb.

14. The bow limb retaining assembly of claim 13 wherein the limb bedding material is applied to at least a portion of a bottom of the bow limb, the at least a portion of the bottom is adjacent the at least a portion of the end portion of the bow limb.

15. The bow limb retaining assembly of claim 1 wherein the at least one limb pocket comprises a limb bolt opening, the limb bolt opening comprising a flange and the at least one bow limb comprises a corresponding limb bolt opening, the limb bedding material is disposed between at least a portion of the flange of the limb pocket and the limb bolt opening in the bow limb.

16. The bow limb retaining assembly of claim 1 wherein the limb pocket comprises two separate slots in combination with at least two split bow limbs, the slots configured and arranged for receiving the at least two split limbs.

17. The bow limb retaining assembly of claim 16 wherein at least a portion of an end portion of each of the at least two split limbs comprises the limb bedding material.

18. The bow limb retaining assembly of claim 17 wherein the limb bedding material is applied to at least a portion of a bottom of each of the at least two split limbs, the at least a portion of the bottom is adjacent the at least a portion of the end portion of the bow limb.

19. The bow limb retaining assembly of claim 1 in combination with an archery bow.

20. A bow limb retaining assembly, the retaining assembly comprising:

a retainer comprising at least one limb pocket, the limb pocket comprising a bottom surface, an end wall portion, a first lateral side wall and a second lateral side wall opposing the first lateral side wall, the first lateral side wall comprising an engaging feature comprising a protrusion or recess;

a bow limb, the bow limb configured and arranged to engage the bottom surface, the end wall portion, the first lateral side wall and the second lateral side wall of the at least one limb pocket, the bow limb comprising a complimentary engaging feature comprising a recess or protrusion, the complimentary engaging feature of the bow limb arranged to engage the engaging feature of the first lateral side wall; and at least one adhesive disposed between the bow limb and at least one of the bottom surface, the end wall portion, the first lateral side wall or the second lateral side wall of the limb pocket, the adhesive contacting the limb pocket and the bow limb.

* * * * *